US010525762B2

(12) United States Patent
Swanick et al.

(10) Patent No.: US 10,525,762 B2
(45) Date of Patent: Jan. 7, 2020

(54) WRITING INSTRUMENT SIDE-KNOCK MECHANISM

(71) Applicant: Sanford, L.P., Atlanta, GA (US)

(72) Inventors: Kenneth Swanick, Downers Grove, IL (US); Bryan Rolfs, Chicago, IL (US)

(73) Assignee: Sanford L.P., Atlanta, GA (US)

( * ) Notice: Subject to any disclaimer, the term of this patent is extended or adjusted under 35 U.S.C. 154(b) by 0 days.

(21) Appl. No.: 15/833,670

(22) Filed: Dec. 6, 2017

(65) Prior Publication Data

US 2018/0154680 A1 Jun. 7, 2018

Related U.S. Application Data

(60) Provisional application No. 62/430,676, filed on Dec. 6, 2016.

(51) Int. Cl.

| | |
|---|---|
| ***B43K 24/08*** | (2006.01) |
| ***B43K 21/22*** | (2006.01) |
| ***B43K 21/027*** | (2006.01) |
| ***B43L 19/00*** | (2006.01) |
| ***B43K 23/016*** | (2006.01) |
| ***B43K 21/02*** | (2006.01) |
| ***B43K 29/02*** | (2006.01) |

(52) U.S. Cl.

CPC ..... *B43K 24/082* (2013.01); *B43K 21/02* (2013.01); *B43K 21/027* (2013.01); *B43K 21/22* (2013.01); *B43K 23/016* (2013.01); *B43K 29/02* (2013.01); *B43L 19/0081* (2013.01); *B43K 24/088* (2013.01)

(58) Field of Classification Search

CPC ..... B43K 21/006; B43K 21/16; B43K 21/22; B43K 21/027; B43K 24/0082; B43K 21/18; B43K 21/20

See application file for complete search history.

(56) References Cited

U.S. PATENT DOCUMENTS

| | | | | |
|---|---|---|---|---|
| 2,881,736 A | | 4/1959 | Zepelovitch | |
| 3,883,253 A | * | 5/1975 | Naruse | B43K 21/20 401/65 |
| 4,270,870 A | * | 6/1981 | Hashimoto | B43K 21/027 401/65 |
| 5,882,132 A | | 3/1999 | Kageyama et al. | |

(Continued)

FOREIGN PATENT DOCUMENTS

| | | |
|---|---|---|
| CN | 1169698 A | 1/1998 |
| CN | 2305294 Y | 1/1999 |

(Continued)

OTHER PUBLICATIONS

A Guide to Zebra Sarasa® Pens. http://www.zebrapen.com/author/editor/page/2/.

(Continued)

*Primary Examiner* — David P Angwin
*Assistant Examiner* — Bradley S Oliver
(74) *Attorney, Agent, or Firm* — Eversheds Sutherland (US) LLP

(57) ABSTRACT

A side-knock type mechanical pencil comprising a body with a side-mounted knock button coupled to the body of the mechanical pencil and adapted to slidingly engage with a lead tube with a frustoconical hub for translating the motion of the knock button actuation to linear extension of the lead.

17 Claims, 5 Drawing Sheets

(56) References Cited

U.S. PATENT DOCUMENTS

| | | | | |
|---|---|---|---|---|
| 5,927,882 | A | 7/1999 | Kageyama | |
| 6,039,484 | A | 3/2000 | Kageyama et al. | |
| 6,065,889 | A | 5/2000 | Maruyama et al. | |
| 6,082,916 | A | 7/2000 | Kageyama et al. | |
| 6,203,226 | B1 | 3/2001 | Suzuki et al. | |
| 6,729,785 | B2 | 5/2004 | Wijerama | |
| 6,758,617 | B2 | 7/2004 | Sakaoka | |
| 6,817,800 | B2 | 11/2004 | Sung | |
| 6,979,142 | B1 | 12/2005 | Chmelar | |
| 7,237,972 | B2 | 7/2007 | Kanari et al. | |
| 7,452,147 | B2 | 11/2008 | Rolion et al. | |
| 7,997,821 | B2 * | 8/2011 | Saitou | B43K 21/16 401/55 |
| 8,480,322 | B2 | 7/2013 | Wang | |
| 9,114,922 | B2 | 8/2015 | Kageyama et al. | |
| 2001/0016140 | A1 | 8/2001 | Kageyama et al. | |
| 2001/0018004 | A1 | 8/2001 | Kageyama et al. | |
| 2004/0047669 | A1 | 3/2004 | Lo | |
| 2007/0134046 | A1 | 6/2007 | Rolion et al. | |
| 2007/0223986 | A1 | 9/2007 | Franck | |
| 2012/0003026 | A1 | 1/2012 | Geddes et al. | |

FOREIGN PATENT DOCUMENTS

| | | | | |
|---|---|---|---|---|
| CN | 2892487 | Y | 4/2007 | |
| CN | 2925911 | Y | 7/2007 | |
| CN | 200977791 | Y | 11/2007 | |
| CN | 201102391 | Y | 8/2008 | |
| CN | 201201412 | Y | 3/2009 | |
| CN | 201371648 | Y | 12/2009 | |
| CN | 201755969 | U | 3/2011 | |
| CN | 101585280 | B | 6/2011 | |
| CN | 102390197 | A | 3/2012 | |
| CN | 202573415 | U | 12/2012 | |
| CN | 204236067 | U | 4/2015 | |
| DE | 357559 | C | 8/1922 | |
| DE | 2821445 | A1 | 11/1979 | |
| EP | 0219001 | A1 * | 4/1987 | B43K 21/027 |
| EP | 0976578 | B1 | 7/2003 | |
| FR | 2874534 | A1 | 3/2006 | |
| JP | H10-329484 | A | 12/1998 | |
| JP | 2000-1087 | A | 1/2000 | |
| WO | 02/102604 | A1 | 12/2002 | |
| WO | 2003/004285 | A1 | 1/2003 | |
| WO | 2011/025047 | A1 | 3/2011 | |
| WO | 2012/023667 | A1 | 2/2012 | |

OTHER PUBLICATIONS

International Search Report and Written Opinion, PCT/US2018/019429, 13 pages, dated Aug. 1, 2018.

* cited by examiner

WRITING INSTRUMENT SIDE-KNOCK MECHANISM

CROSS REFERENCE TO RELATED APPLICATIONS

This application claims priority benefit of U.S. Provisional Application No. 62/430,676, titled "Writing Instrument" and filed on Dec. 6, 2016, which is incorporated herein by reference.

FIELD OF THE DISCLOSURE

This disclosure generally relates to writing instruments, and more specifically relates to side-knock mechanisms for use with mechanical pencils.

BACKGROUND

Writing instruments, and specifically pencils, have been in widespread use for hundreds of years, with mechanical pencils dating as far back as the 18th century. With the advent of mechanical pencils, a pencil could be used continuously by simply refilling the modular lead housed in the body. A variety of different mechanical pencil configurations are known in the art including various mechanisms for retaining and advancing lead or other writing mediums within the writing instrument. In general, mechanical pencils expose the lead for writing by driving it forward when a knock button is pressed. The knock button may be disposed on the end of the pencil, or on the side. Generally at rest, the lead is selectively fixed by a split chuck or similar gripping mechanism that cooperates with the lead tube to hold the lead and deliver it to the writing tip of the writing instrument. Upon the actuation of the knock button, the mechanism cycles, a process which includes advancing the lead tube, which increases the force exerted by a return element on the lead tube, which opens the chuck, and allows the lead tube to walk back with respect to the lead without moving the lead.

In conventional side-knock configurations, any slight rotation of the lead tube with respect to the knock button must be prevented during actuation in order to ensure that the knock button properly aligns with the feature on the lead tube to completely cycle the mechanism. Rotation of the lead tube in such a conventional side-knock style writing instrument can cause undesirable misalignment of the knock button and the lead tube feature that can result in failure of the mechanism to cycle, meaning failure of the tube to advance, or result in reduced actuation distance that impairs lead delivery to the writing tip of the instrument.

Conventional side-knock writing instruments typically include a guide structure either on the barrel, the lead tube, or both, to prevent such rotation. Guides can include grooves on the barrel or cooperating structures between the lead tube and the barrel that prevent rotation during actuation. This adds complexity and cost to the manufacture of the writing instruments. Such additional structures must be aligned during assembly of the writing instrument and provide yet another source of potential error during the manufacturing process. The guide structures and complexity added can also increase problems with use or breakage of the writing instrument or lead during use, if the guide structure fails or breaks.

Accordingly, a need exists to create a simple, reliable, side-knock mechanism for mechanical pencils that overcomes one or more of the disadvantages of current designs.

SUMMARY OF THE INVENTION

In accordance with one embodiment of the disclosure, a writing instrument with a body, the body being a generally hollow tubular shape with an inner lumen, outer surface opposite the inner lumen, first end, and second end opposite the first end, a lead tube with a first tube end, a second tube end opposite the first tube end, and an outer tube surface, a knock button, coupled to the body, and a frustoconical hub, where the frustoconical hub is disposed around the outer tube surface of the lead tube and positioned along a length of the lead tube such that at least a portion of the knock button slides along the frustoconical hub when the knock button is actuated. The mechanism described herein allows the translation of the pivoting or rotational motion of the knock button actuation, to a linear motion of the lead tube.

In another embodiment of the disclosure, a writing instrument includes a body, the body is a generally hollow tube defining an inner lumen, an outer surface opposite the inner lumen, a first end, and a second end opposite the first end, where the first end is a writing end with a generally conical writing tip with a tip aperture, the body also includes an aperture extending between the outer surface and the inner lumen. The writing instrument also includes a lead tube with an inner tube lumen, outer tube surface opposite the inner tube lumen, and a frustoconical hub disposed around the outer tube surface, at least one writing medium, the writing medium being disposed within the inner lumen of the lead tube, and a knock button, where the knock button is disposed in the aperture of the body and is configured to slidably engage the frustoconical hub when actuated, sliding the lead tube towards the writing end.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
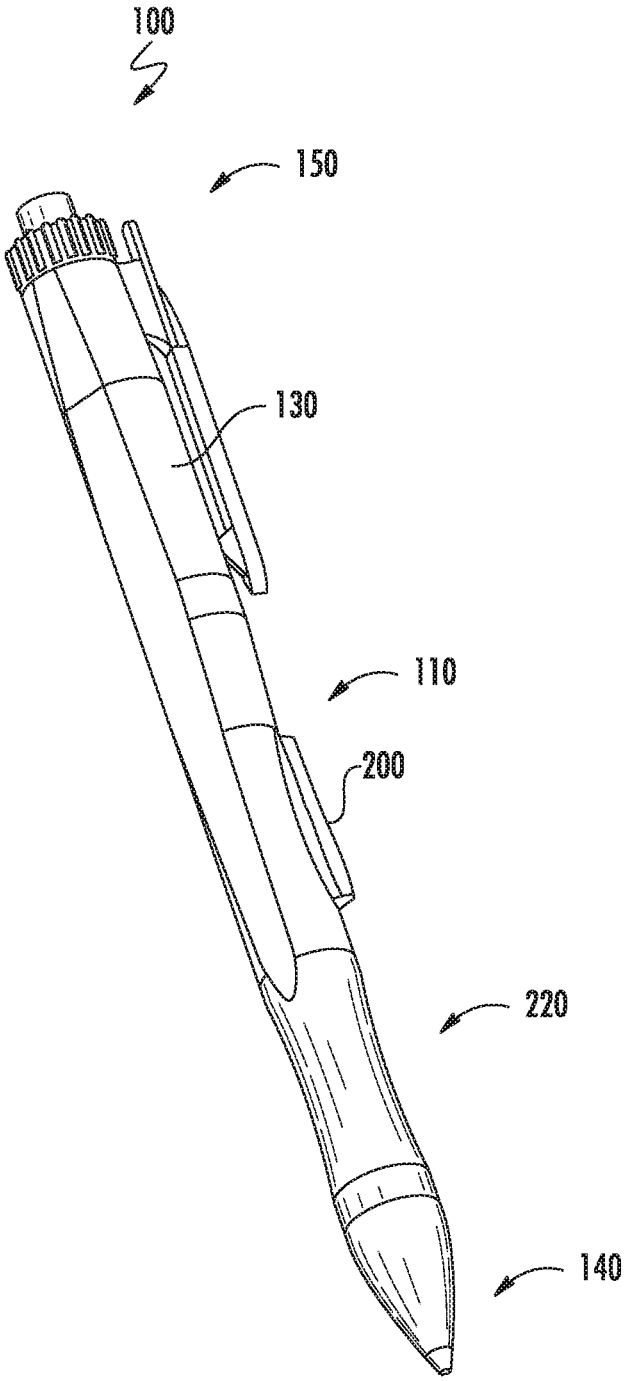
FIG. 1 is a perspective view of a writing instrument in accordance with one example embodiment of the present disclosure.

The writing instruments and side knock button mechanisms described herein advantageously can accommodate various writing mediums. The present disclosure includes non-limiting embodiments of writing instruments and side-knock button mechanisms. The embodiments are described in detail herein to enable one of ordinary skill in the art to practice the writing instruments and associated side-knock button mechanisms, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

The meanings of the terms used herein will be apparent to one of ordinary skill in the art or will become apparent to one of ordinary skill in the art upon review of the detailed description when taken in conjunction with the several drawings and the appended claims. While certain discussion is made herein with respect to pencil lead, it should be understood that the present disclosure could be used with other writing mediums within the scope of the present disclosure. As used herein, the terms "connect," "mount," "couple," and other similar terms are used broadly to refer to any suitable direct or indirect connection mechanism.

Throughout this disclosure, various aspects of this disclosure are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Figure 2:
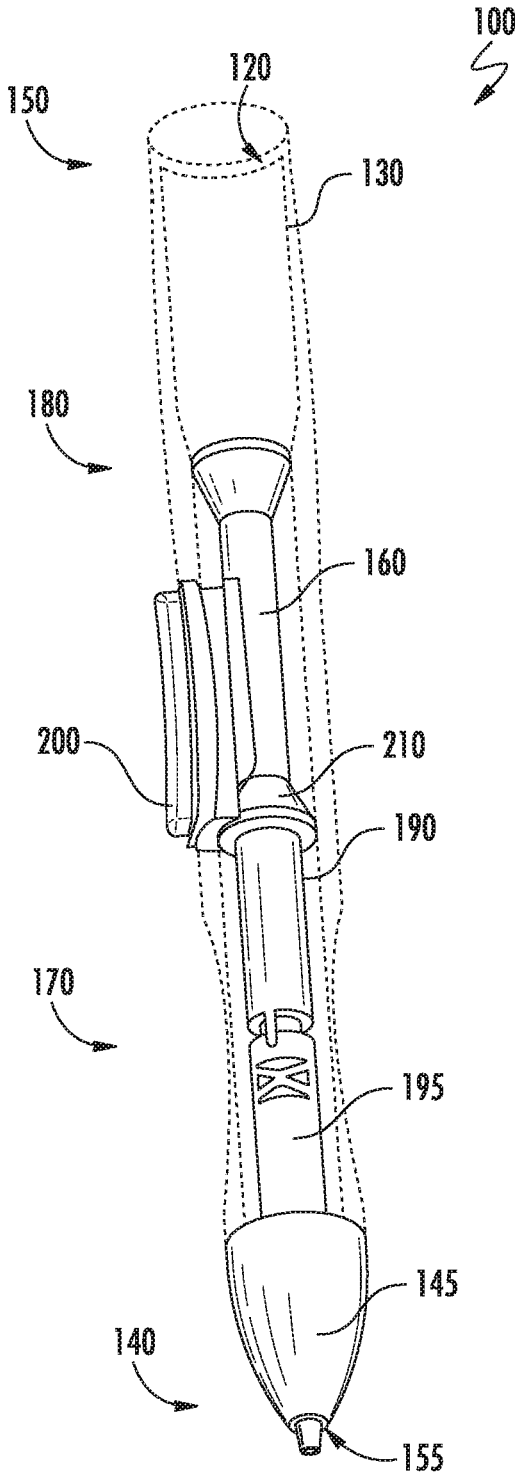
FIG. 2 is a transparent side view illustrating the internal components of the writing instrument of FIG. 1.

FIG. 1 illustrates a writing instrument 100 in accordance with one or more embodiments of the disclosure. As shown in FIGS. 1 and 2, the writing instrument 100 includes a body 110 that may be a generally hollow tubular shape with an inner lumen 120, an outer surface 130 opposite the inner lumen, a first end 140, a second end 150 opposite the first end 140, a lead tube 160, a knock button 200 mounted to the body 110, and a frustoconical hub 210. The lead tube 160 includes a first tube end 170, a second tube end 180 opposite the first tube end, and an outer tube surface 190. The frustoconical hub 210 may be disposed around the outer tube surface 190 of the lead tube 160 and positioned along the length of the lead tube 160 such that at least a portion of the knock button 200 slides along the frustoconical hub 210 when the knock button 200 is actuated.

Figure 3:
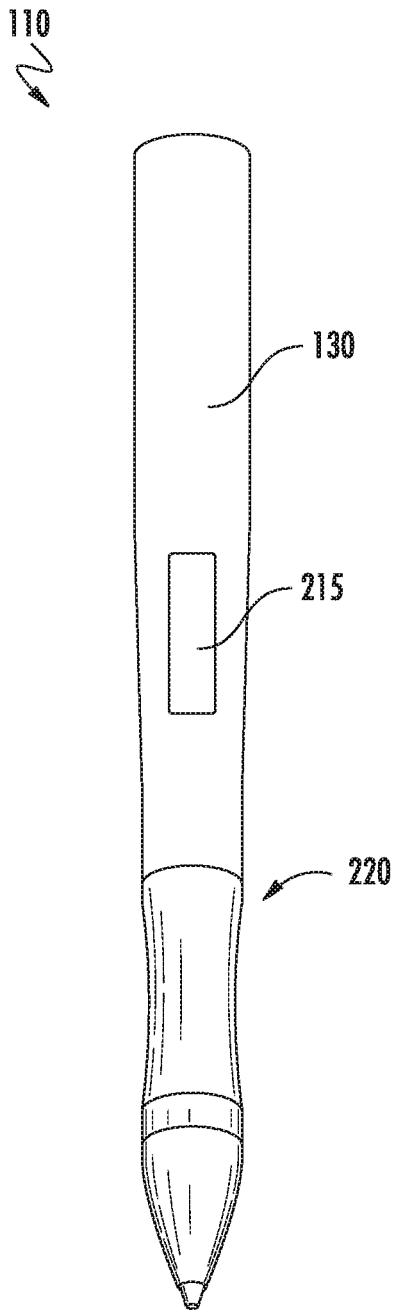
FIG. 3 is a side view of a body of the writing instrument of FIG. 1.

As shown in FIG. 3, the body 110 of the writing instrument 100 may include an aperture 215 in the outer surface 130 of the body 110 extending between the outer surface 130 and the inner lumen 120. The aperture 215 is configured to receive the knock button 200 and may be positioned in a variety of locations along the length of the body 110. As shown in FIG. 1, the knock button 200 can be positioned just above a gripping region 220 so as to not interfere with a user's grip of the writing instrument 100 and to facilitate ease of actuation of the knock button 200.

Figure 4A:
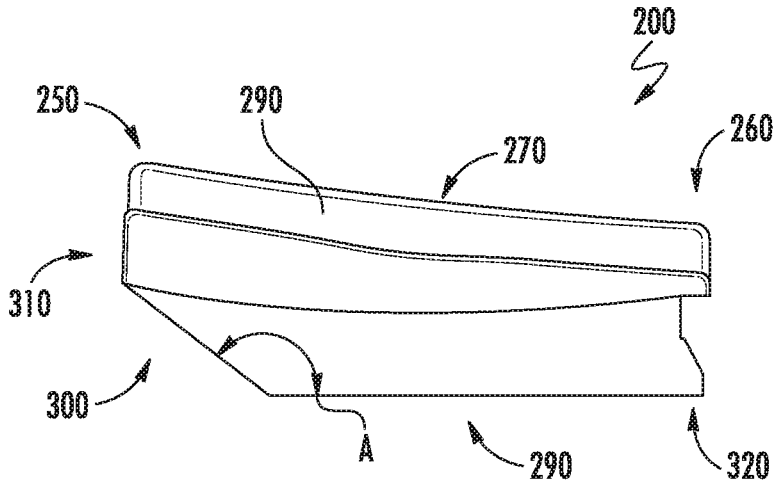
FIG. 4A is a side view of a knock button of the writing instrument of FIG. 1.
Figure 4B:
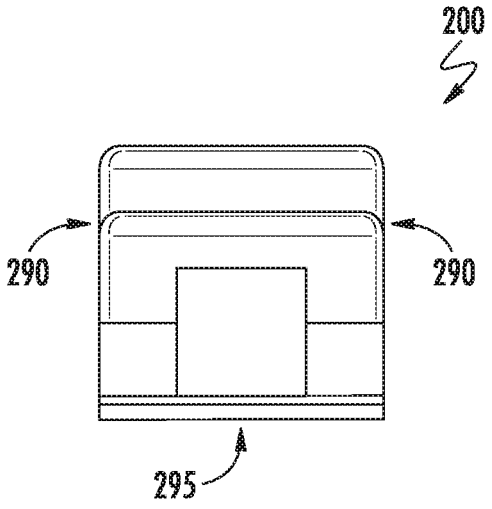
FIG. 4B is a front view of a knock button of the writing instrument of FIG. 1.

FIGS. 4A and 4B show a knock button 200 in accordance with one or more embodiments of the disclosure. The knock button 200 includes a front end 250, a pivot end 260 opposite the front end 250, a top surface 270, a bottom surface 280 opposite the top surface 270, and at least one sidewall 290. The top surface 270 is pressed by the user to actuate the knock button 200 and cycle the writing instrument. In some exemplary embodiments, the knock button 200 also includes a sliding surface 300 that extends between the front end 250 and the bottom surface 280. In embodiments in which the sliding surface 300 of the knock button 200 is straight, the angle (A) between the sliding surface 300 and the bottom surface 280 may be about 105° to about 145°. In some embodiments, the sliding surface 300 may be configured as a straight incline or chamfer. Other embodiments of the sliding surface 300 and the bottom surface 280 may include curved surfaces, decreasing radius curved surfaces, angled surfaces, or other geometries or profiles to impact the tactile response of the button and an appropriate resulting motion of the lead tube to ensure sufficient lead delivery.

In some embodiments, the sliding surface 300 originates at a distance from the top surface 270 of the knock button 200, creating a front surface 310 at the front end 250 of the knock button 200, as shown in FIG. 4A. In other embodiments, the sliding surface 300 originates at or adjacent to the top surface 270 without any front surface 310. In yet other embodiments, the sliding surface is an extension, projection, or corner of the sidewall 290 or front surface 310. In some embodiments with a front surface 310, the height of the top surface 270, meaning the normal distance between the top surface 270 and its intersection with the sliding surface 300, may be about 0.09 inches to about 0.095 inches. Finally, in certain embodiments, the knock button 200 may only touch the frustoconical hub 210 when the knock button 200 is actuated. That is, there may be a gap between the knock button 200 and the frustoconical hub 210 when the button is at rest.

Figure 5:
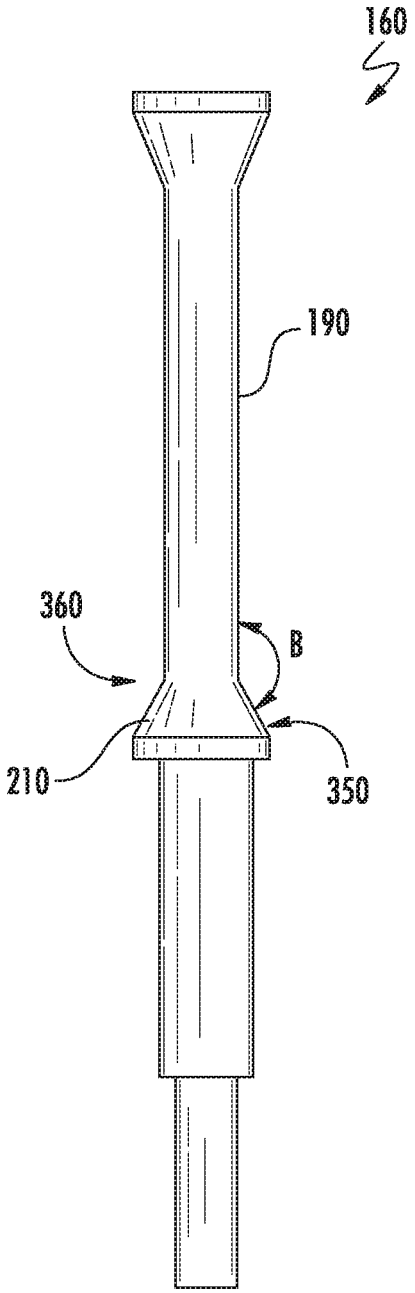
FIG. 5 is a side view of a lead tube of the writing instrument of FIG. 1.

The lead tube 160 houses lead or other writing mediums and actuates to deliver the writing medium to the writing tip of the writing instrument 100. As illustrated in FIG. 5, the lead tube 160 includes a frustoconical hub 210 that is disposed around the outer surface 130 of the lead tube 160. In certain embodiments, the frustoconical hub 210 can be integrally formed with the lead tube 160. In other embodiments, the frustoconical hub can be separate from the lead tube 160 and attached to the lead tube 160 by any known manner of fixation such as press fitting, adhesive bonding, or ultrasonic welding. The knock button 200, described above, has at least one surface that interacts with the frustoconical hub 210 to actuate the lead tube 160. The lead tube 160 cycles with the pressing and release of the knock button 200 in order to deliver lead to the writing tip. The sliding action of the sliding surface 300 of the knock button 200 along the frustoconical hub 210 forces the lead tube 160 in a direction toward the first end 140 of the body. When the knock button is released, the sliding surface 300 is slides in the reverse direction along the frustoconical hub 210 and the lead tube 160 is returned to its resting position.

Interaction between the knock button 200 and a frustoconical hub 210 for actuation of the lead tube 160 prevents the need for any guide structures to be added to the lead tube 160 or body 110 to prevent rotation of the lead tube 160 during cycling. The frustoconical hub 210 provides 360° of contact surfaces along which the sliding surface 300 of the knock button 200 can be guided during actuation. This advantageously greatly simplifies and reduces overall cost of the writing instrument. Unlike conventional side-knock writing instruments, assembly of writing instruments in accordance with embodiments of the disclosure only requires linear alignment of the frustoconical hub 210 with the knock button 200. Linear alignment can be achieved with the insertion of the lead tube 160 into the body 110, as the location of the frustoconical hub 210 on the lead tube 160 can be preselected based on the length of the lead tube 160 and the selected location of the knock button 200.

Certain embodiments of the writing instrument 100 include a knock button 200 that is pivotally mounted to the body 110 and that can pivot between a rest position and actuated position. In some embodiments the knock button 200 pivots about integrated protrusions that mate with the body. In other examples, the knock button 200 pivots about a pinned axis. Other methods of pivotally mounting the knock button 200 to the body 110 are contemplated herein. In one example, the knock button 200 is fixed at the front end 250 near the second end 150 of the body 110, and can be depressed near the front end 250 of the knock button 200 to actuate the knock button 200. The knock button 200 could also be fixed at the front end 250 and actuated by depressing the rear end 320 of the knock button 200. Referring again to FIG. 5, the frustoconical hub 210 includes a taper surface 350. The taper surface 350 intersects with the outer tube surface 190 at a vertex end 360 of the frustoconical hub 210 and defines a taper angle B. The taper angle (B) may be about 135° to about 170°.

In some exemplary embodiments, as shown in FIG. 2, the vertex end 360 of the frustoconical hub 210 and the front end 250 of the knock button 200 are both disposed near the second end 150 of the body 110. In one example, as shown in FIG. 2, the writing instrument also includes a return element 195. The return element 195 is adapted to bias the lead tube 160 towards the second end 150 of the body 110, causing the knock button 200 to return to the rest position when not pressed, and thus, to bias the lead tube 160 reward when the knock button 200 is not pressed. In certain embodiments the return element 195 is a compression spring. In other embodiments, the return element 195 is an elastically deformable plastic support. Other return elements 195 capable of biasing the lead tube 160 towards the second end 150 of the body 110 may also be used.

In another example embodiment, the writing instrument 100 includes a body 110 that is a generally hollow tube defining an inner lumen 120, an outer surface 130 opposite the inner lumen 120, a first end 140, and a second end 150 opposite the first end 140. The first end 140 is a writing end with a generally conical writing tip 145 and a tip aperture 155. The body 110 also includes an aperture 215 that extends between the outer surface 130 and the inner lumen 120. The writing instrument 100 may also include a lead tube 160 with an inner lumen 120, an outer tube surface 190 opposite the inner lumen, a frustoconical hub 210 disposed around the outer surface 130 of the lead tube 160, and a knock button 200. The knock button 200 may be disposed in the aperture 215 of the body 110, and be configured to slidably engage the frustoconical hub 210 when the knock button 200 is actuated, sliding the lead tube 160 toward the writing end 140.

In some embodiments, a return element 195 is included that biases the lead tube 160 back towards the second end 150 of the body 110. The writing instrument also includes a chuck that is configured to cooperate with and selectively grip the writing medium. When the knock button 200 is actuated, the lead tube 160 moves towards the first end of the body 110. As tension increases in the return element 195, it disengages the chuck, which allows the lead tube 160 to move rearward without retracting the writing medium when the knock button 200 is released. As shown in FIG. 4B, in some exemplary embodiments, the knock button 200 may include a bottom surface 280 with a slot 295 therein. This slot 295 may be configured for receiving at least a portion of the lead tube 160.

The lead tube 160 must travel a sufficient distance to advance the lead and then release the lead chuck so as not to pull the lead backwards as the lead tube retracts. By changing the stroke of the lead tube 160 that results from the knock button 200 actuation, the number of times the knock button 200 must be pressed to extend a certain length of lead can be altered. For example, the desired actuation of the lead tube 160 can be between about 0.15 inches and about 0.20 inches, or between about 0.15 inches and about 0.175 inches, or between about 0.125 inches and about 0.20 inches.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific mechanisms and configurations, it will be appreciated that numerous other mechanisms and configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A writing instrument comprising:

a body, wherein the body comprises a generally hollow tubular shape with an inner lumen, an outer surface opposite the inner lumen, a first end, and a second end opposite the first end;

a lead tube comprising a first tube end, a second tube end opposite the first tube end, and an outer tube surface;

a knock button, coupled to the body, the knock button comprising a front end, a pivot end, a top surface, an arcuate bottom surface, and at least one sidewall, wherein the knock button comprises a sliding surface extending between the front end and the arcuate bottom surface; and a frustoconical hub integrally formed with the lead tube, the frustoconical hub comprising a taper surface aligned with the arcuate bottom surface, wherein the frustoconical hub is disposed around the outer tube surface of the lead tube and is positioned along a length of the lead tube such that the arcuate bottom surface contacts and wraps at least partially around the taper surface of the frustoconical hub when the knock button is actuated.

2. The writing instrument of claim 1, wherein the body further comprises an aperture in the outer surface of the body, the aperture being configured to receive the knock button.

3. The writing instrument of claim 1, wherein an angle between the arcuate bottom surface and the sliding surface is about 105° to about 145°.

4. The writing instrument of claim 1, wherein the knock button is pivotally mounted to the body and pivots between a rest position and an actuated position.

5. The writing instrument of claim 1, wherein the taper surface intersects the outer tube surface at a vertex end of the frustoconical hub and defines a taper angle.

6. The writing instrument of claim 5, wherein the taper angle is about 135° to about 170°.

7. The writing instrument of claim 5, further comprising a gripping region disposed on the writing instrument, wherein the vertex end of the frustoconical hub and the pivot end of the knock button are both disposed between the gripping region and the second end.

8. The writing instrument of claim 1, wherein the writing instrument further comprises a return element, the return element being adapted to bias the lead tube towards the second end of the body.

9. The writing instrument of claim 8, wherein the return element is a compression spring.

10. The writing instrument of claim 1, wherein the knock button further comprises a front surface, defined by the area of the front end between the top surface and the intersection of the sliding surface and the front end, the front surface having a height of about 0.09 inches to about 0.095 inches.

11. A writing instrument comprising:

a body, the body comprising a generally hollow tube defining an inner lumen, an outer surface opposite the inner lumen, a first end, and a second end opposite the first end, wherein the first end is a writing end comprising a generally conical writing tip with a tip aperture, and wherein the body further comprises an aperture extending between the outer surface and the inner lumen;

a lead tube comprising an inner tube lumen, an outer tube surface opposite the inner tube lumen, and a frustoconical hub disposed around the outer tube surface of the lead tube, wherein the frustoconical hub comprises a taper surface;

at least one writing medium, the writing medium disposed within the inner lumen of the lead tube; and a knock button having an arcuate bottom surface comprising a slot configured for receiving at least a portion of the lead tube, wherein the knock button is disposed in the aperture of the body, and is configured to slidably engage the frustoconical hub when the knock button is actuated, sliding the lead tube towards the writing end.

12. The writing instrument of claim 11, further comprising a chuck, the chuck configured to cooperate with and selectively grip the writing medium.

13. The writing instrument of claim 12, wherein the longitudinal motion of the lead tube upon actuation of the knock button, disengages the chuck.

14. The writing instrument of claim 11, further comprising a spring element configured to bias the lead tube towards the second end of the body.

15. The writing instrument of claim 11, wherein the body further comprises a gripping region.

16. The writing instrument of claim 15, wherein the aperture in the body is disposed between the gripping region and the second end of the body.

17. The writing instrument of claim 11, wherein the frustoconical hub is integrally formed with the lead tube.

* * * * *